United States Patent [19]

Hastings et al.

[11] Patent Number: 4,486,728

[45] Date of Patent: Dec. 4, 1984

[54] SHARED FLUX RECIPROCAL ELECTROMAGNETIC ACTUATOR

[75] Inventors: Jerome K. Hastings, Sussex; James H. Bigelow, Milwaukee, both of Wis.

[73] Assignee: Eaton Corporation, Cleveland, Ohio

[21] Appl. No.: 406,614

[22] Filed: Aug. 9, 1982

[51] Int. Cl.[3] ..... H01F 7/08

[52] U.S. Cl. ..... 335/256; 335/268

[58] Field of Search ..... 335/256, 258, 260, 266, 335/268

[56] References Cited

U.S. PATENT DOCUMENTS

| | | | |
|---|---|---|---|
| 3,183,410 | 5/1965 | Flora | 335/261 X |
| 3,743,898 | 7/1973 | Sturman | 335/268 X |
| 3,784,943 | 1/1974 | Markowitz et al. | 335/266 |

*Primary Examiner*—George Harris

*Attorney, Agent, or Firm*—Andrus, Sceales, Starke & Sawall

[57] ABSTRACT

An electromagnetic actuator is provided by an armature plunger which reciprocally shuttles between magnetic paths having common overlapping portions through the plunger. A magnetically permeable yoke directs the flux paths of a pair of coaxial coils. When either coil is energized, a first flux path is created around that coil through the plunger and a second flux path is created around both coils through the plunger. The first path pulls the plunger to close an axial magnetic air gap. The second path holds the plunger in place. The ratio of the permeances of the two paths is controlled such that one path always overpowers the other, to insure plunger movement in either direction.

19 Claims, 1 Drawing Figure

SHARED FLUX RECIPROCAL ELECTROMAGNETIC ACTUATOR

BACKGROUND AND SUMMARY

The invention relates to an electromagnetic actuator having a single armature plunger that reciprocally shuttles between magnetic paths. A pair of coils are energizable to create magnetic fluxes having portions of their linkage paths in common, including through the plunger.

When either coil is energized, a flux path is created around that coil through the plunger, and another flux path is created around both coils through the plunger. The ratio of the permeances of the two paths is controlled such that one path always overpowers the other, to insure plunger movement in either direction.

In one aspect of the invention, movement of the plunger from one position to the other induces a voltage signal in the nonenergized coil. This voltage signal may be used as an indication of plunger movement, whereby to afford feedback verification of actuation of the plunger to its other position. This feedback verification is afforded without additional sensing circuitry; instead, existing flux linkages are used.

In further aspects of the invention, the electromagnetic actuator is inexpensive, compact, and extremely fast.

DETAILED DESCRIPTION

Figure 1:
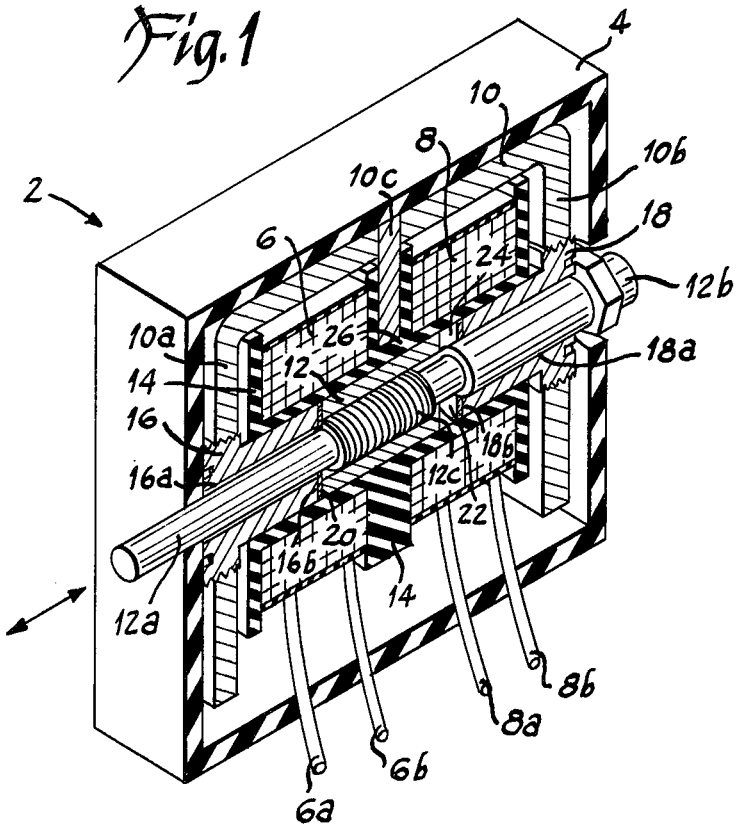
FIG. 1 is a cutaway isometric view of an electromagnetic actuator constructed in accordance with the invention.

Electromagnetic actuator 2 includes a housing 4 having a pair of coaxially mounted coils 6 and 8 energizable by means of leads 6*a* and 6*b* and 8*a* and 8*b* to create magnetic flux. A magnetically permeable yoke 10 directs the flux paths of the coils, and armature plunger 12 is axially reciprocal between left and right positions.

The coils are wound around an insulating bobbin 14. Yoke 10 is an E-shaped member having first and second outer legs 10*a* and 10*b* and a center leg 10*c*. The yoke further includes magnetically permeable insets 16 and 18 screwed into outer legs 10*a* and 10*b* for directing the flux path back inwardly. Insets 12 and 18 have axial bores 16*a* and 18*a* for guiding axial movement of extension shafts 12*a* and 12*b* of plunger 12. Shafts 12*a* and 12*b* are secured to plunger 12 in threaded relation. The inner end 16*b* of inset 16 provides a left stop shoulder for limiting the axial movement of plunger 12. A nonmagnetic spacer washer 20 is disposed between stop shoulder 16*b* and plunger 12. The inner end 18*b* of inset 18 provides a right stop shoulder for limiting rightward axial movement of plunger 12. Nonmagnetic spacer washer 22 is disposed against right stop shoulder 18*b*. FIG. 1 shows plunger 12 in its leftward position abutting nonmagnetic spacer 20 and stop shoulder 16*b* of yoke, thus leaving a gap 24 between the right edge 12*c* of the plunger and nonmagnetic spacer 22 against shoulder 18*b* of the yoke.

When right coil 8 is energized, a primary flux path is created which extends around right coil 8 through yoke 10 through axial gap 24 between stop shoulder 18*b* and plunger 12, through plunger 12 through a radial gap 26 across the bobbin between plunger 12 and center leg 10*c* of the yoke, through center leg 10*c*, and back to right yoke leg 10*b* to complete the primary loop. Energization of the right coil 8 also creates a secondary flux path which extends around both coils 6 and 8, through yoke 10, through axial gap 24, through plunger 12, through shoulder stop 16*b* and yoke inset 16, through left yoke leg 10*a*, and across the top of the yoke back to right yoke leg 10*b* to complete the secondary loop. The primary flux path around energized coil 8 tends to pull plunger 12 rightwardly to close axial magnetic air gap 24. The secondary flux path around both coils 6 and 8 tends to hold plunger 12 in place in its leftward position against washer 20 and stop shoulder 16*b*. The ratio of the permeances of the two flux paths is controlled such that one path always overpowers the other, to insure plunger movement in either direction.

The primary and secondary fluxes created in response to energization of coil 8 have portions of their linkage paths in common, including through plunger 12. The ratio of the radial width of gap 26 to the axial width of spacer 20 sets the ratio of the primary and secondary flux forces created by coil 8. The dimensions of these gaps may be determined empirically, or mathemetically through Gaussian equations solved simultaneously. In one embodiment, the width of spacer 20 is 0.010 inch, and the width of gap 26 is 0.012. These particular dimensions in the embodiment shown insure that the primary path around coil 8 is stronger than the secondary path around both coils. The structure is symmetric, and the width of spacer 22 is the same as the width of spacer 20 whereby when plunger 12 is in its rightward position and coil 6 is energized, the primary flux path force around coil 6 is stronger than the secondary flux path force around both coils, to insure leftward movement of plunger 12.

Armature shuttle plunger 12 is thus reciprocal in housing 4 between left and right positions respectively closing and opening first and second gaps between plunger 12 and yoke 10 at inset shoulder stops 16*b* and 18*b*. Plunger 12 is in overlapping flux paths in each of its left and right positions. Energization of the right coil 8 creates a primary flux around the latter attracting the plunger to its rightward position to close right gap 24 and open a left gap between the left edge of plunger 12 and spacer 20 against left shoulder stop 16*b*. Energization of right coil 8 also creates a secondary flux around both coils attracting plunger 12 to remain in its leftward position with the left gap closed and the right gap 24 open.

Energization of left coil 6 creates a primary flux around the latter attracting plunger 12 to its leftward position to close the left gap and open the right gap 24, and creates a secondary flux around both coils attracting plunger 12 to remain in its rightward position with right gap 24 closed and the left gap open. The force on plunger 12 from the primary flux path around either coil is always stronger than the force on the plunger from the secondary path.

Extension shafts 12*a* and 12*b* perform a given function, such as closing or opening electrical contacts, a hydraulic circuit, or various other functions. These extension shafts need not be identical, as shown by right shaft 12*b* being enlarged and having an integral hex nut near its end.

In a desirable aspect of the invention, movement of plunger 12 induces a voltage signal in the nonenergized coil, which signal affords feedback verification of actuation of the plunger to its other position. This feedback verification is afforded without additional sensing circuitry; instead existing flux linkages are used. For example, when plunger 12 moves rightwardly in response to energization of coil 8, plunger movement induces a voltage signal in the nonenergized coil 6.

It is recognized that various modifications are possible within the scope of the appended claims.

We claim:

1. Electromagnetic actuator means comprising an armature plunger for reciprocally axially shuttling between magnetic paths having common overlapping portions through the plunger provided by magnetically continuous yoke means directing the flux paths of a pair of coaxial coils such that when either coil is energized a first path is created around that coil through the plunger and a second flux path is created around both coils through the plunger, the first path pulling the plunger to close a magnetic air gap, the second path holding the plunger in place, the flux paths from the axial ends of said plunger extending substantially only axially to said yoke means, said yoke means having a central leg extending radially between said coils, said leg having an inner end facing said plunger and separated therefrom by a radial gap, the axial length of said radial gap being no greater than the axial spacing of said coils, the ratio of the permeances of the two paths being controlled such that one path always overpowers the other, preventing residual magnetic latching, to insure plunger movement in either direction without the need for mechanical assistance.

2. The invention according to claim 1 wherein said plunger reciprocates between first and second positions, and comprising first nonmagnetic spacer means axially between said yoke means and said plunger in said first position, and second nonmagnetic spacer means axially between said yoke means and said plunger in said second position.

3. The invention according to claim 1 wherein movement of said plunger induces a voltage signal in the nonenergized coil whereby to afford feedback verification of actuation of said plunger, using an existing flux linkage path and without auxiliary sensors.

4. Electromagnetic actuator means comprising:

a housing;

a pair of coils coaxially mounted in said housing and energizable to create magnetic flux;

magnetically continuous yoke means in said housing for directing the flux paths of said coils through portions of common overlapping flux linkage;

an armature shuttle plunger axially reciprocal in said housing according to energization of a respective said coil such that when either coil is energized a flux path is created around that coil through the plunger and another flux path is created around both coils through the plunger, the flux paths from the axial ends of said plunger extending substantially only axially to said yoke means, said yoke means having a central leg extending radially between said coils, said leg having an inner end facing said plunger and separated therefrom a radial gap, the axial length of said radial gap being no greater than the axial spacing of said coils, said yoke means controlling the ratio of the permeances of the two paths such that one path always overpowers the other, preventing residual magnetic latching, to insure plunger movement in either direction without the need for mechanical assistance.

5. The invention according to claim 4 wherein said common overlapping linkage path extends axially through said plunger, and said plunger reciprocates axially therealong.

6. The invention according to claim 4 wherein said flux path around the energized coil tends to pull said plunger to close an axial magnetic air gap, and said other flux path around both coils tends to hold said plunger in place.

7. The invention according to claim 4 wherein said yoke means includes first nonmagnetic spacer means in a closed axial magnetic air gap adjacent said plunger in a first position and second nonmagnetic spacer means in a second closed axial magnetic air gap adjacent said plunger in a second position of the latter.

8. Electromagnetic actuator means comprising:

a housing;

first and second coaxial coils in said housing energizable to create magnetic flux;

magnetically continuous yoke means in said housing for directing the flux of said coils in partially overlapping paths;

an armature shuttle plunger in said housing axially reciprocal between first and second positions respectively closing and opening first and second gaps between said plunger and said yoke means, said plunger being in said overlapping flux paths in each of said first and second positions, energization of said first coil creating a primary flux around the latter attracting said plunger to said first position to close said first gap and open said second gap, and creating a secondary flux around both said coils attracting said plunger to remain in said second position with said second gap closed and said first gap open, energization of said second coil creating a primary flux around the latter attracting said plunger to said second position to close said second gap and open said first gap, and creating a secondary flux around both said coils attracting said plunger to remain in said first position with said first gap closed and said second gap open, the flux paths from the axial ends of said plunger extending substantially only axially to said yoke means, said yoke means having a central leg extending radially between said coils, said leg having an inner end facing said plunger and separated therefrom by a radial gap, the axial length of said radial gap being no greater than the axial spacing of said coils, the force on said plunger from the primary flux path around either coil being always stronger than the force on said plunger from the secondary flux path, preventing residual magnetic latching and insuring plunger movement from either said position without the need for mechanical assistance.

9. Electromagnetic actuator means comprising:

a housing;

a pair of coils coaxially mounted in said housing and energizable to create magnetic flux;

magnetically continuous yoke means in said housing for directing the flux paths of said coils; and a shuttle plunger axially reciprocal in said coils between first and second positions according to energization of a respective said coil providing a primary flux path around the respective said coil through said yoke means and said plunger, and providing a secondary flux path around both said coils through said yoke means and said plunger, the flux paths from the axial ends of said plunger extending substantially only axially to said yoke means, said yoke means having a central leg extending radially between said coils, said leg having an inner end facing said plunger and separated therefrom by a radial gap, the axial length of said radial gap being no greater than the axial spacing of said coils, such that the primary path flux force around either coil is always stronger than the secondary path, preventing residual magnetic latching and insuring plunger movement from either said position without the need for mechanical assistance.

10. The invention according to claim 9 wherein:

said yoke means includes first and second axially spaced stop shoulders for limiting said axial movement of said plunger at respective said first and second positions;

such that when said plunger is in said second position and said first coil is energized, said primary flux path extends around said first coil through said yoke means and across an axial gap between said first stop shoulder of said yoke means and said plunger and through said plunger and across said radial gap between said plunger and said central leg of said yoke means, and said secondary path extends around both said coils through said yoke means and across said axial gap between said first stop shoulder of said yoke means and said plunger and through said plunger and through said second stop shoulder of said yoke means; and such that when said plunger is in said first position and said second coil is energized, said primary flux path extends around said second coil through said yoke means and across an axial gap between said second stop shoulder of said yoke means and said plunger and through said plunger and across said radial gap between said plunger and said central leg of said yoke means, and said secondary path extends around both said coils through said yoke means and across said axial gap between said second stop shoulder of said yoke means and said plunger and through said plunger and through said first stop shoulder of said yoke means.

11. The invention according to claim 8 comprising first non-magnetic spacer means between said plunger and said first stop shoulder of said yoke means, and second non-magnetic spacer means between said plunger and said second stop shoulder of said yoke means.

12. The invention according to claim 11 wherein said yoke means comprises non-cylindrical E-shaped means having first and second outer legs, and said central leg therebetween, said first coil being between said central leg and said first outer leg, said second coil being between said central leg and said second outer leg, said central leg being a narrow member with a non-flared inner end radially facing said plunger across said radial gap and defining the axial length of said radial gap to a dimension no greater than the axial space between said coils.

13. The invention according to claim 12 wherein said first stop shoulder is on said first outer leg of said E-shaped means, and said second stop shoulder is on said second outer leg of said E-shaped means.

14. The invention according to claim 13 wherein said co-axis of said coils is the same axis of reciprocation of said plunger, said outer legs and said center leg of said E-shaped means extend parallel to each other and perpendicular to said axis, and said outer legs further have end portions extending back inwardly towards each other along said axis.

15. The invention according to claim 12 wherein:

said plunger slides along said axis between said first and second shoulder stops, with said gap between said plunger and said center leg of said E-shaped yoke means remaining the same;

said gap between said first shoulder stop and said plunger in said second position is set by the axial width of said second spacer means; and said gap between said second shoulder stop and said plunger in said first position is set by the axial width of said first spacer means.

16. The invention according to claim 15 wherein:

energization of said first coil, when said plunger is in said second position, creates said primary path flux force attracting said plunger to said first position closing the gap between said plunger and said first shoulder stop, and creates said secondary path flux force attracting said plunger to remain in said second position;

the ratio of the radial width of said gap between said plunger and said center leg of said E-shaped yoke means to the axial width of said second spacer means setting the ratio of said last mentioned primary and secondary flux forces whereby to control the net magnitude and direction of force on said plunger upon energization of said first coil;

energization of said second coil, when said plunger is in said first position, creates said primary path flux force attracting said plunger to said second position closing the gap between said plunger and said second shoulder stop, and creates said secondary path flux force attracting said plunger to remain in said first position; and the ratio of the radial width of said gap between said plunger and said center leg of said E-shaped yoke means to the axial width of said first spacer means setting the ratio of said last mentioned primary and secondary flux forces whereby to control the net magnitude and direction of force on said plunger upon energization of said second coil.

17. The invention according to claim 9 wherein:

movement of said plunger from said second position to said first position induces a voltage signal in said second coil indicating plunger movement whereby to afford feedback verification of actuation to said first position; and movement of said plunger from said first position to said second position induces a voltage signal in said first coil indicating plunger movement whereby to afford feedback verification of actuation of said second position.

18. Electromagnetic actuator means comprising:

a housing;

a pair of coaxial coils in said housing energizable to create magnetic flux;

a shuttle plunger in said housing axially movable between first and second positions;

magnetically continuous yoke means in said housing for directing the flux paths of said coils, said yoke means having a first portion spaced from said plunger by a first axial gap when said plunger is in said second position, said yoke means having a second portion spaced from said plunger by a second axial gap when said plunger is in said first position, said yoke means having a third portion spaced from said plunger by a third gap in each of said first and second plunger positions;

such that when said plunger is in said second position and said first coil is energized, a primary flux path is created and extends around said first coil through said yoke means and said plunger and across said first and third gaps, and a secondary flux path is created and extends around both said coils through said yoke means and said plunger and across said first gap, said primary path flux force attracting said plunger to said first position to close said first gap, said secondary path flux force attracting said plunger to remain in said second position; and such that when said plunger is in said first position and said second coil is energized, a primary flux path is created and extends around said second coil through said yoke means and said plunger and across said second and third gaps, and a secondary flux path is created and extends around both said coils through said yoke means and said plunger and across said second gap, said last mentioned primary path flux force attracting said plunger to said second position to close said second gap, said last mentioned secondary path flux force attracting said plunger to remain in said first position, the flux paths from the axial ends of said plunger extending substantially only axially through respective said first and second gaps to said yoke means, said third portion of said yoke means being a central leg extending radially between said coils, said leg having an inner end facing said plunger and separated radially therefrom by said third gap, the axial length of said third gap being no greater than the axial spacing of said coils, the force on said plunger from said primary flux around either said coil always being stronger than the force on said plunger from said secondary flux, preventing residual magnetic latching, such that said plunger moves in either direction responsive to the primary flux in the open gap without the need for mechanical assistance.

19. The invention according to claim 18 comprising:

first non-magnetic spacer means axially between said yoke means and said plunger in said first position, the ratio of the axial width of said spacer means to the radial width of said third gap setting the ratio of said second mentioned primary and secondary flux forces such that the primary flux force is greater than the secondary flux force; and second non-magnetic spacer means axially between said yoke means and said plunger in said second position, the ratio of the axial width of said second spacer means to the radial width of said third gap setting the ratio of said first mentioned primary and secondary flux forces such that the primary flux force is greater than the secondary flux force.

* * * * *